US006929716B2

(12) United States Patent
Müch et al.

(10) Patent No.: US 6,929,716 B2
(45) Date of Patent: Aug. 16, 2005

(54) METHOD FOR THE MANUFACTURE OR TREATMENT OF A MATERIAL WEB

(75) Inventors: Rudolf Müch, Königsbronn (DE); Raymond P. Shead, Kent (GB)

(73) Assignee: Voith Paper Patent GmbH, Heidenheim (DE)

( * ) Notice: Subject to any disclaimer, the term of this patent is extended or adjusted under 35 U.S.C. 154(b) by 154 days.

(21) Appl. No.: 10/375,468

(22) Filed: Feb. 27, 2003

(65) Prior Publication Data

US 2003/0164228 A1 Sep. 4, 2003

(30) Foreign Application Priority Data

Mar. 1, 2002 (EP) ..... 02019399
Aug. 30, 2002 (EP) ..... 02004783

(51) Int. Cl.[7] ..... D21F 7/00

(52) U.S. Cl. ..... 162/198; 73/78; 73/159; 162/199; 162/252; 162/253; 162/263; 162/272; 162/274; 162/275

(58) Field of Search ..... 73/78, 159; 162/198, 162/262, 263, 252, 253, 199, 272, 274, 275

(56) References Cited

U.S. PATENT DOCUMENTS

| | | | | |
|---|---|---|---|---|
| 3,194,061 A | | 7/1965 | Sorenson, et al. | 73/81 |
| 3,540,270 A | | 11/1970 | Wolfer | 73/78 |
| 5,611,893 A | | 3/1997 | Pajula et al. | 162/360.2 |
| 5,795,440 A | * | 8/1998 | Ampulski et al. | 162/117 |

FOREIGN PATENT DOCUMENTS

| | | | |
|---|---|---|---|
| DE | 691 29 788 | 11/1998 | D21F/3/04 |
| EP | 0 024 205 | 2/1981 | D21F/1/32 |
| EP | 0 298 057 | 1/1989 | D21G/1/00 |
| EP | 0 487 483 | 11/1991 | D21F/3/04 |
| GB | 1 328 158 | 8/1973 | |
| WO | WO 91/13337 | 9/1991 | G01N/3/40 |
| WO | WO 96/03616 | 2/1996 | G01B/11/02 |

* cited by examiner

*Primary Examiner*—Peter Chin
(74) *Attorney, Agent, or Firm*—Taylor & Aust, P.C.

(57) ABSTRACT

A method for the manufacture or treatment of a material web, in particular of a paper or a cardboard web, while using a respective machine, in particular a paper machine, including the step of measuring the hardness and/or the compactness of at least one clothing, in particular of at least one felt, fabric, belt and/or the like, of the machine.

32 Claims, 2 Drawing Sheets

METHOD FOR THE MANUFACTURE OR TREATMENT OF A MATERIAL WEB

BACKGROUND OF THE INVENTION

1. Field of the Invention

The present invention relates to method for the manufacture or treatment of a material web, in particular of a paper or cardboard web, while using a respective machine, in particular a paper machine. The present invention further relates to an apparatus for measuring the hardness and/or the compactness of at least one clothing, in particular, of at least one felt, fabric, belt and/or the like, of a machine, in particular, of a paper machine, for the manufacture or treatment of a material web, in particular of a paper or cardboard web.

2. Description of the Related Art

Previous technologies for studying machine clothing involved online studies of moisture and/or permeability of machine clothing in order to determine their condition and performance. These studies were unable to provide information regarding the compaction (or density) of the machine clothing in cross direction or in machine direction over time. Apart from this, such measurements were unable to provide any indication of nip profile in situations where the clothing had passed through a pressing operation. A method of this kind is described, for example, in U.S. Pat. No. 5,611,893 and DE 691 29 788 T2.

SUMMARY OF THE INVENTION

The present invention, provides a method for the manufacture or treatment of a material web, in particular of a paper or cardboard web, while using a respective machine, in particular a paper machine, including the step of measuring the hardness and/or the compactness of at least one clothing, in particular, of at least one felt, fabric, belt and/or the like, of the machine.

In accordance with a preferred practical embodiment of the method of the present invention, the hardness and/or the compactness of the machine clothing is continuously measured. Preferably, the measurement of the hardness and/or the compactness of the machine clothing is carried out in machine direction and/or in cross machine direction. In an expedient practical embodiment of the present invention an online measurement of the hardness and/or the compactness of the machine clothing is carried out.

The measurement of the hardness and/or the compactness of the machine clothing can, for example, be carried out in at least one of the following sections of the machine: forming section, pressing section, drying section.

In accordance with another practical embodiment of the method of the invention, a hardness and/or compactness control of the machine clothing is carried out. In accordance with an embodiment of the method of the present invention, the measurement values obtained by the measurement of the hardness and/or the compactness of that machine clothing are used for optimizing the nip profile of at least one press section. Alternatively, or additionally, the measurement values obtained by the measurement of the hardness and/or the compactness of the machine clothing can be used for monitoring the life and/or condition of the machine clothing and as an indicator for their replacement.

Alternatively, or additionally, the measurement values obtained by the measurement of the hardness and/or the compactness of the machine clothing can be used for optimizing the use of cleaning showers in order to minimize compaction and extend clothing life. Alternatively, or additionally, the measurement values obtained by the measurement of the hardness and/or the compactness of the machine clothing can be used for a high-frequency analysis of the machine clothing and/or associated rotating machine elements which affect clothing compaction. In accordance with an expedient embodiment of the method of the present invention, the measurement values obtained by that measurement of the hardness and/or the compactness of the machine clothing are used for controlling the condition of that machine clothing. Such a control of the condition of the machine clothing can, for example, be carried out by controlling at least one sectionalized nip profiling and/or crown profiling equipment in order to optimize cross direction clothing compaction, nip impression and/or cross-machine web quality.

In accordance with another advantageous embodiment of the present invention, the control of the condition of that machine clothing is carried out by controlling the average load pressure of a nip in order to optimize the pressing efficiency clothing compaction and extend the life of the machine clothing. The measuring of the hardness and/or the compactness of at least one clothing, in particular of at least one felt, fabric, belt and/or the like, can be carried out without contacting or with contacting said at least one felt, fabric, belt and/or the like, for example, with a rotating wheel or with a counter roll.

In accordance with an embodiment of the present invention, an apparatus is provided for measuring the hardness and/or the compactness of at least one clothing, in particular, of at least one felt, fabric, belt and/or the like, of a machine, in particular of a paper machine, for the manufacture or treatment of a material web, in particular of a paper or cardboard web, the apparatus includes at least one rotating wheel which contacts the machine clothing at its region of rotation around a counter roll, and at least one hardness and/or compactness sensor associated with the rotating wheel or with the counter roll. The sensor is preferably embedded in the rotating wheel or counter roll, or attached at the sensing support arm. In the latter case, a plurality of sensors can be embedded in the counter roll in cross machine direction.

In accordance with a preferred practical embodiment of the apparatus of the present invention, the rotating wheel is displaceable in cross machine direction. The rotating wheel is preferably displaceable along a support rail. In accordance with a preferred practical embodiment of the apparatus, the rotating wheel is subjected to a given force which may be changed from scan to scan. The periodicity of the force changes is variable, preferably either by time or by runs. The periodicity is determined preferably by process and/or machine clothing conditions. In addition, the exerted force has dynamic characteristics, preferably an offset and a dynamic share.

The measurement at each force provides a signal which is proportional to the elasticity and/or compaction and/or dampening properties of the machine clothing. In accordance with a preferred embodiment of the apparatus of the present invention, the sensor provides a signal which is proportional to the hardness and/or compaction of said machine clothing. The sensor can, for example, be a piezo crystal sensor. In some cases it might be expedient to use a contacting caliper sensor. The sensor is preferably positioned by way of a pressure controlled apparatus. Furthermore, the sensor can be controlled by force or travel direction, either path and/or angle.

With the method and apparatus of the present invention it is possible, for example, to establish a continuous hardness and/or compaction measurement and control of, for example, a felt, fabric or belt on a paper machine. The apparatus can provide continuous machine direction and cross machine measurement of the hardness of paper machine clothing often referred to as felts, fabrics and belts. The apparatus can include a rotating wheel which contacts the paper machine clothing at its point of rotation around a turn roller or counter roll. The contacting roller can contain an embedded hardness sensor, or a plurality of sensors, which provide a signal which is proportional to the hardness or compaction of the paper machine clothing.

The apparatus may be able to provide the following information to the user:

trend information covering the life of the felt, fabric or belt in order to assess the condition of the machine clothing;

profile information (cross machine measurement) of the felt, fabric or belt to indicate the uniformity of the clothing's compaction;

profile information used to determine the condition of any nip the clothing has passed through;

individual measurement for each felt or fabric in the manufacturing process, particularly for a press section where the performance and condition of each nip, felt/fabric can be optimized for paper quality and felt/fabric life;

a historical database system providing archive data for use in comparative and absolute analysis of felts, fabrics, belts and rotating mechanical elements of the paper machine; and high frequency machine direction analysis for the rotating machine clothing and the mechanical elements that can imprint their signature into the clothing.

The present invention provides direct measurement of clothing compaction and is able to be used as a continuous online analysis and trouble-shooting tool in paper machine forming sections, pressing operations and drying sections. There can be a certain sensor size to wheel width ratio. A situation, where the wheel presses into the felt and as a consequence provides an inaccurate measurement, should be avoided. The measurement signal can, for example, be transmitted down a scanner power track and processed in an off-sheet electronics box, i.e., a so called NIC (network intelligent controller). It is possible to measure the average compactness over time from average data. This data can be plotted on an x-y-graph with a lower limit defined for the limit of felt compactness. Once the compaction of the felt reaches this limit then it will be described as reaching the end of its life. Felts have a certain compactness value to be successful in any given press position. Consequently, felt data can be archived such that the machine operators can access this information remotely and use it to provide customer support and competitive felt analysis.

As to the optimization of the felt life time and the press efficiency/quality, the CD (cross direction) felt compactness profile reflects the press nip profile. The aim can be to have a flat compactness profile in order to deliver uniform dewatering across the web. The nip profiling system can be used to flatten the compactness profile. It can also be interesting to adjust the nip load and observe felt compactness and express moisture value. A control strategy can be realized which provides maximum dewatering with minimum press load while extending felt life. For controlling the sectionalized nip profiling and crown profiling elements in order to optimize CD-clothing compaction and paper quality (e.g., moisture CD profile), closed loop control can be applied using the compactness profile with the nip controlled zones.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION OF THE INVENTION

Figure 1:
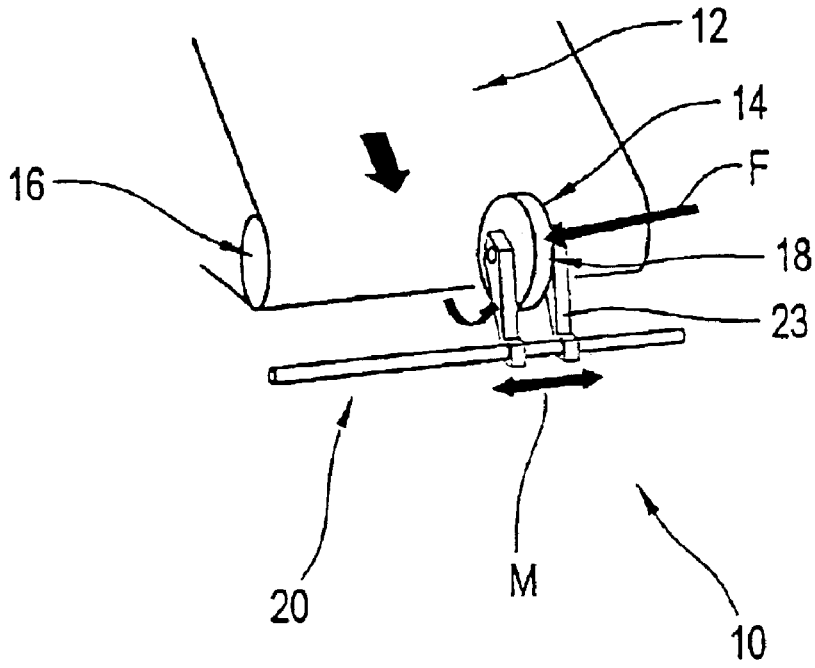
FIG. 1 is a perspective view of an apparatus for measuring the hardness and/or the compactness of machine clothing, which apparatus includes a rotating wheel.

Referring now to the drawings, and more particularly to FIG. 1, there is shown apparatus 10 for measuring the hardness and/or the compactness of at least one clothing 12, in particular of at least one felt, fabric, belt and/or the like, of a machine, in particular of a paper machine, for the manufacture or treatment of a material web, in particular of a paper or cardboard web. Apparatus 10 includes rotating wheel 14 which contacts machine clothing 12 at its point of rotation around a counter or turn roll 16.

At least one embedded hardness and/or compactness detection sensor 18 is mounted in rotating wheel 14. Such a hardness and/or compactness sensor can also be embedded in counter roll 16. In the latter case, at least one sensor 18 can be embedded in counter roll 16 in cross machine direction or it is attached at sensing support arm 23 of rotating wheel 14. As indicated by arrow M, rotating wheel 14 is connected preferably between two sensing support arms 23 and it is displaceable in a cross machine direction. With the present embodiment, rotating wheel 14 is displaceable along support rail 20. Rotating wheel 14 can be subjected to force F which can be changed from scan to scan. The periodicity of the force changes is variable, preferably either by time or by runs. The periodicity is determined preferably by process and/or machine clothing conditions. In addition, exerted force F has dynamic characteristics, preferably an offset and a dynamic share. The offset can, for example, be x Newton and the dynamic share can by y Newton, whereas the offset can be used for the measurement of any damping qualities. The measurement at each force F provides a signal which is proportional to the elasticity and/or compaction and/or dampening properties of the machine clothing.

Figure 2:
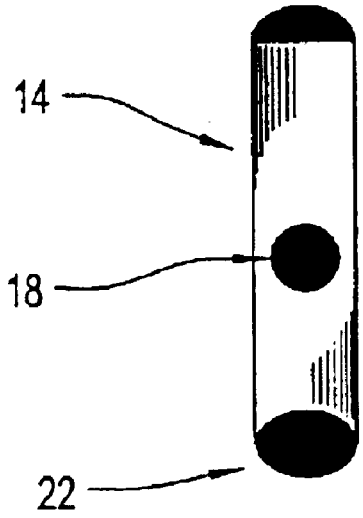
FIG. 2 is a partial illustration of the wheel of FIG. 1 in a larger scale.

FIG. 2 shows a partial illustration of rotating wheel 14 of FIG. 1 in a larger scale. In FIG. 2, the radius profile for rotating wheel 14 is indicated at 22. Sensor 18 can provide a signal which is proportional to the hardness and/or compaction of machine clothing 12. Sensor 18 can be, for example, a piezo crystal sensor. In some cases it is possible to use a contacting caliper sensor for sensor 18. Sensor 18 can be positioned, for example, by way of at least one pressure cylinder, in particular at least one light air pressure cylinder. Sensor 18 can be controlled by force or travel direction, either path and/or angle.

Figure 3:
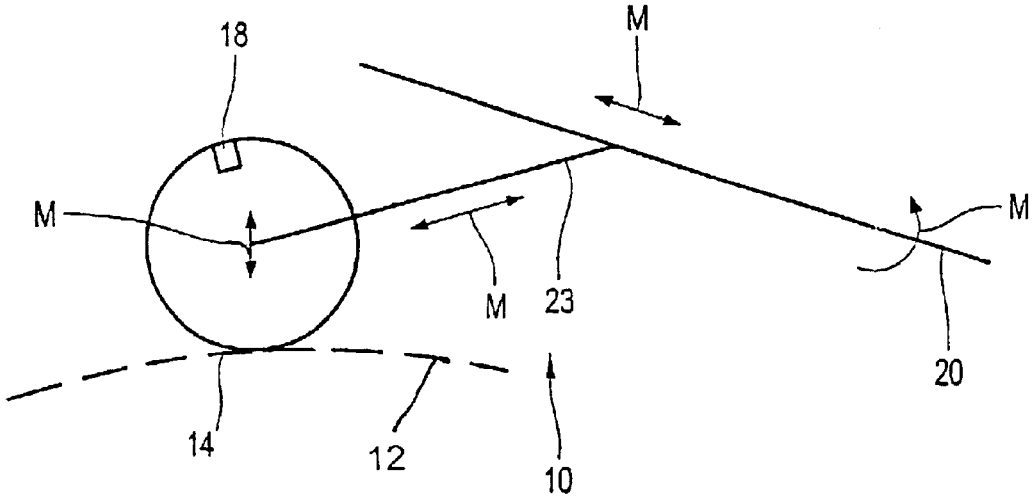
FIG. 3 is a schematic perspective view of an apparatus according to one exemplary embodiment of the present invention Corresponding reference characters indicate corresponding parts throughout the several views. The exemplifications set out herein illustrate one preferred embodiment of the invention, in one form, and such exemplifications are not to be construed as limiting the scope of the invention in any manner.

FIG. 3 shows a perspective schematic illustration of apparatus 10 according to one exemplary embodiment of the present invention. In the embodiment of FIG. 3, apparatus 10 includes rotating wheel 14 (movement by arrow M) which contacts machine clothing 12 (broken line) at its point of rotation around a not shown counter or turn roll. Rotating wheel 14 is connected by at least one sensing support arm 23 (movement by arrow M) and it is displaceable in a cross machine direction and around machine direction (movements by arrow M). With the present embodiment, rotating wheel 14 is displaceable along support rail 20.

In FIG. 3 at least one embedded hardness and/or compactness detection sensor 18 (schematic illustration) is mounted in rotating wheel 14 for measuring, for example, force, pressure or displacement. Such a hardness and/or compactness sensor can also be embedded in a counter roll (not shown) preferably in a plurality. In the latter case, at least one sensor 18 can be attached at sensing support arm 23 (schematic illustration) of rotating wheel 14 for measuring, for example, force or displacement with the use of at least one wire strain gauge. Additionally, or alternatively, also the movement of rotating wheel 14 towards or away from machine clothing 12 (broken line) can be measured by, for example, a contacting caliper or a inductive proximity switch, preferably with the surface of the counter roll (not shown) as a reference.

Apparatus 10 provides continuous machine direction (MD) and cross machine (CD) measurement of the hardness of paper machine clothing 12 often referred to as felts, fabrics and belts. One or a plurality of hardness and/or compactness sensors 18 can be embedded in rotating wheel 14 or counter roll 16 or attached at sensing support arm 23, respectively. The signal provided by a respective sensor 18 can be proportional to the hardness or compaction of the machine clothing 12.

Apparatus 10 can, for example, be used on machine measurements to show the condition of clothing in terms of machine direction (MD) and cross direction (CD) compaction (and/or hardness). The information obtained by the at least one sensor 18 can be used to:

- optimize the nip profiles of press sections;
- monitor the life and condition of machine clothing to use as an indicator for their replacement;
- optimize the use of cleaning showers in order to minimize compaction and extend felt/fabric life; and
- high-frequency analysis of machine clothing and associated rotating machine elements which affect clothing compaction.

The obtained sensor signals can further be used for controlling the condition of machine clothing through:

- control of sectionalized nip profiling and crown profiling equipment in order to optimize cross direction clothing compaction, nip impression and cross-machine paper quality; and
- control the average load pressure of a nip in order to optimize the pressing efficiency felt/fabric compaction and extend the life of the machine clothing.

Apparatus 10 can generally be used as an analysis tool for the products to be manufactured.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. In a paper machine, a method for the manufacture or treatment of a fiber material web, comprising the step of measuring at least one of a hardness and a compactness of at least one clothing for use with the machine while said at least one clothing is on the machine.

2. The method of claim 1, wherein the fiber material web is one of a paper web and a cardboard web.

3. The method of claim 1, wherein the clothing is one of a felt, a fabric and a belt.

4. The method of claim 1, wherein at least one of said hardness and said compactness is continuously measured.

5. The method of claim 1, wherein said measuring step is carried out in one of a machine direction and a cross machine direction.

6. In a paper machine, a method for the manufacture or treatment of a fiber material web, comprising the step of measuring at least one of a hardness and a compactness of at least one clothing for use with the machine, wherein said measuring step includes an online measurement of at least one of said hardness and said compactness.

7. In a paper machine, a method for the manufacture or treatment of a fiber material web, comprising the step of measuring at least one of a hardness and a compactness of at least one clothing for use with the machine, wherein said measuring step is carried out in at least one of a forming section, a pressing section and a drying section of the machine.

8. The method of claim 1, further including the step of controlling at least one of said hardness and said compactness of said clothing following said measuring step.

9. In a paper machine, a method for the manufacture or treatment of a fiber material web, comprising the step of measuring at least one of a hardness and a compactness of at least one clothing for use with the machine, further including the step of optimizing a nip profile of at least one press section of the machine using at least one measurement value of at least one of said hardness and said compactness obtained by said measuring step, said optimizing step following said measuring step.

10. In a paper machine, a method for the manufacture or treatment of a fiber material web, comprising the step of measuring at least one of a hardness and a compactness of at least one clothing for use with the machine, further including the step of monitoring at least one of a life and a condition of said clothing using at least one measurement value of at least one of said hardness and said compactness obtained by said measuring step, said monitoring step providing an indicator of a need for replacement of said clothing, said monitoring step following said measuring step.

11. In a paper machine, a method for the manufacture or treatment of a fiber material web, comprising the step of measuring at least one of a hardness and a compactness of at least one clothing for use with the machine, further including the step of optimizing a use of at least one clean shower using at least one measurement value of at least one of said hardness and said compactness obtained by said measuring step, said optimizing step thereby minimizing a compaction of said clothing and extending a life of said clothing, said optimizing step following said measuring step.

12. In a paper machine, a method for the manufacture or treatment of a fiber material web, comprising the step of measuring at least one of a hardness and a compactness of at least one clothing for use with the machine, further including the step of high-frequency analyzing of at least one measurement value of at least one of said hardness and said compactness obtained by said measuring step, said high-frequency analyzing step providing high-frequency analysis of at least one of said clothing and at least one associated rotating machine element which affect clothing compaction, said high-frequency analyzing step following said measuring step.

13. In a paper machine, a method for the manufacture or treatment of a fiber material web, comprising the step of measuring at least one of a hardness and a compactness of at least one clothing for use with the machine, further including the step of controlling a condition of said clothing using at least one measurement value of at least one of said hardness and said compactness obtained by said measuring step.

14. The method of claim 13, wherein said controlling step is carried out by controlling at least one of a sectionalized nip profiling equipment and a crown profiling equipment to optimize at least one of a cross direction clothing compaction, a nip impression and a cross machine web quality.

15. The method of claim 13, wherein said controlling step is carried out by controlling an average load pressure of a nip to optimize a pressing efficiency clothing compaction and extend a life of said clothing.

16. In a paper machine, a measuring apparatus, comprising:

a counter roll carrying the clothing;

at least one rotating wheel contacting the clothing at a region of rotation of the clothing around said counter roll; and at least one of a hardness sensor and a compactness sensor associated with at least one of said rotating wheel and said counter roll.

17. The apparatus of claim 16, wherein the clothing is one of a felt, a fabric and a belt.

18. The apparatus of claim 16, further including at least one sensing support arm attached to said rotating wheel, at least one said sensor is one of embedded in said rotating wheel, embedded in said counter roll and attached at at least one said sensing support arm.

19. The apparatus of claim 16, further including a plurality of sensors, the machine has a machine cross direction, said plurality of sensors is embedded in said counter roll in said machine cross direction.

20. The apparatus of claim 16, wherein the machine has a machine cross directions said rotating wheel is displaceable in said machine cross direction.

21. The apparatus of claim 16, further including a support rail connected to said rotating wheel, said rotating wheel is displaceable along said support rail.

22. The apparatus of claim 21, further including a force exerting on said rotating wheel, said support rail having a length, said displacing of said rotating wheel over entire said length constituting a scan, said force changeable from a scan to another scan.

23. The apparatus of claim 22, further including a periodicity associated with said force changes, said periodicity is variable.

24. The apparatus of claim 23, wherein said periodicity is variable in one of time and by run.

25. The apparatus of claim 22, wherein said force has at least one dynamic characteristic.

26. The apparatus of claim 25, wherein at least one said dynamic characteristic is one of an offset and a dynamic share.

27. The apparatus of claim 22, wherein said sensor provides a measurement associated with said force, said sensor provides a signal associated with said measurement, said clothing includes at least one of an elasticity, a compaction and a dampening property, said signal is proportional to at least one of said elasticity of said clothing, said compaction of said clothing and said dampening property of said clothing.

28. The apparatus of claim 16, wherein said sensor provides a signal proportional to at least one of the hardness of the clothing and the compaction of the clothing.

29. The apparatus of claim 16, wherein said sensor is a piezo crystal sensor.

30. The apparatus of claim 16, wherein said sensor is a contacting caliper sensor.

31. The apparatus of claim 16, further including a pressure controlled apparatus associated with said sensor, said sensor is positioned by said pressure controlled apparatus.

32. The apparatus of claim 22 wherein said sensor is controlled by one of said force and a travel direction.

* * * * *